US007820354B2

(12) United States Patent
Shirai

(10) Patent No.: US 7,820,354 B2
(45) Date of Patent: Oct. 26, 2010

(54) METHOD FOR PRODUCING TONER

(75) Inventor: Eiji Shirai, Wakayama (JP)

(73) Assignee: Kao Corporation, Toyko (JP)

( * ) Notice: Subject to any disclaimer, the term of this patent is extended or adjusted under 35 U.S.C. 154(b) by 973 days.

(21) Appl. No.: 11/578,292

(22) PCT Filed: Apr. 20, 2005

(86) PCT No.: PCT/JP2005/007546

§ 371 (c)(1),
(2), (4) Date: Oct. 13, 2006

(87) PCT Pub. No.: WO2005/103833

PCT Pub. Date: Nov. 3, 2005

(65) Prior Publication Data

US 2007/0207401 A1 Sep. 6, 2007

(30) Foreign Application Priority Data

Apr. 20, 2004 (JP) ..... 2004-124431

(51) Int. Cl.
*G03G 9/08* (2006.01)

(52) U.S. Cl. ..... 430/137.2; 430/109.4

(58) Field of Classification Search ..... 430/109.4, 430/137.1, 137.2
See application file for complete search history.

(56) References Cited

U.S. PATENT DOCUMENTS

| | | | | |
|---|---|---|---|---|
| 3,856,552 | A | 12/1974 | Deyak | |
| 5,624,079 | A * | 4/1997 | Higuchi et al. | 241/39 |
| 5,729,805 | A * | 3/1998 | Chiba et al. | 399/276 |
| 6,002,900 | A * | 12/1999 | Ishiyama | 430/110.4 |
| 6,077,635 | A * | 6/2000 | Okado et al. | 430/45.54 |
| 6,383,705 | B2 | 5/2002 | Aoki et al. | |
| 2001/0031414 | A1 * | 10/2001 | Yoshida et al. | 430/108.3 |
| 2002/0048713 | A1 * | 4/2002 | Komoto et al. | 430/124 |
| 2002/0160289 | A1 * | 10/2002 | Teshima et al. | 430/108.1 |
| 2003/0039910 | A1 * | 2/2003 | Shirai et al. | 430/109.4 |
| 2003/0129518 | A1 * | 7/2003 | Sawada et al. | 430/109.4 |
| 2003/0215731 | A1 * | 11/2003 | Saiki et al. | 430/110.3 |
| 2004/0137350 | A1 * | 7/2004 | Yamazaki et al. | 430/108.7 |
| 2004/0137354 | A1 * | 7/2004 | Yamazaki et al. | 430/109.4 |
| 2004/0229148 | A1 * | 11/2004 | Kadota et al. | 430/111.4 |
| 2005/0147911 | A1 | 7/2005 | Shirai et al. | |
| 2005/0227157 | A1 | 10/2005 | Shirai | |
| 2005/0227160 | A1 | 10/2005 | Shirai et al. | |
| 2006/0105262 | A1 * | 5/2006 | Sata et al. | 430/109.4 |

FOREIGN PATENT DOCUMENTS

| | | |
|---|---|---|
| JP | 64-35456 | 2/1989 |
| JP | 1-163757 | 6/1989 |
| JP | 8-15909 | 1/1996 |
| JP | 2001-222138 | 8/2001 |
| JP | 2002-328490 | 11/2002 |
| JP | 2002328490 A * | 11/2002 |
| JP | 2003-246920 | 9/2003 |
| JP | 2004-240071 | 8/2004 |
| JP | 2005-84566 | 3/2005 |

OTHER PUBLICATIONS

Machine translation of JP 2002-328490 (Nov. 2002).*
U.S. Appl. No. 12/541,483, filed Aug. 14, 2009, Shirai, et al.

* cited by examiner

*Primary Examiner*—Christopher RoDee
(74) *Attorney, Agent, or Firm*—Oblon, Spivak, McClelland, Maier & Neustadt, L.L.P.

(57) ABSTRACT

The present invention relates to a process for producing a toner including the steps of melt-kneading raw materials containing two or more kinds of polyesters, heat-treating a melt-kneaded product, pulverizing a heat-treated product, and classifying a pulverized product, wherein the two or more kinds of polyesters contain at least one kind of an amorphous polyester, and the heat-treating step is carried out at a temperature t (° C.) and time h (hour) satisfying the following formulas (a) and (b), $$Tg_1 \leqq t \leqq Tm-10 \quad \text{(a)}$$

$$h \geqq 100/(t-30), \text{ with proviso that } t>30 \quad \text{(b)}$$

wherein $Tg_1$ is a glass transition temperature (° C.) of the melt-kneaded product before the heat-treating step; and Tm is the lowest softening point (° C.) of softening points of the two or more kinds of polyesters, and the toner produced by the process. The toner obtained according to the present invention is suitably used, for example, for developing latent images formed in electrophotography, electrostatic recording method, electrostatic printing method, or the like.

15 Claims, No Drawings

METHOD FOR PRODUCING TONER

TECHNICAL FIELD

The present invention relates to a process for producing a toner used for, for example, developing a latent image formed in electrophotography, electrostatic recording method, electrostatic printing method, or the like, and the toner obtainable by the process.

BACKGROUND ART

In recent years, a low-temperature fixable toner has been earnestly desired from the viewpoint of speeding up and miniaturizing an apparatus, and a combined use of a low-softening point amorphous resin and a crystalline resin (see Patent Publication 1), or the like has been studied.

On the other hand, when a copolymer in which a crystalline polyester and an amorphous vinyl resin which are mutually incompatible are chemically bound is used as a resin binder, the provision of a heat treatment step has been known to be effective in improving crystallinity (see Patent Publication 2 and Patent Publication 3).

Patent Publication 1: JP 2001-222138 A
Patent Publication 2: JP-A-Sho 64-35456
Patent Publication 3: JP-A-Hei 1-163757

SUMMARY OF THE INVENTION

The present invention relates to a process for producing a toner including the steps of melt-kneading raw materials containing two or more kinds of polyesters, heat-treating a melt-kneaded product, pulverizing a heat-treated product, and classifying a pulverized product, wherein the two or more kinds of polyesters contain at least one kind of an amorphous polyester, and the heat-treating step is carried out at a temperature t (° C.) and time h (hour) satisfying the following formulas (a) and (b), $$Tg_1 \leqq t \leqq Tm-10 \quad \text{(a)}$$

$$h \geqq 100/(t-30), \text{ with proviso that } t>30 \quad \text{(b)}$$

wherein $Tg_1$ is a glass transition temperature (° C.) of the melt-kneaded product before the heat-treating step; and Tm is the lowest softening point (° C.) of softening points of the two or more kinds of polyesters, and the toner obtainable by the process.

DETAILED DESCRIPTION OF THE INVENTION

While the combined use of an amorphous resin and a crystalline resin is effective in improving a low-temperature fixing ability, a glass transition temperature of a toner is lowered as compared to a glass transition temperature of an amorphous resin, so that pulverizability or storage property is likely to be insufficient.

With regards to the provision of the heat-treating step in the production of a toner, as shown in a comparative example (Comparative Example 3) of Patent Publication 3, these is no effect by a heat treatment in a simple mixture of resins, so that it is necessary to carry out a graft polymerization. In other words, no method of recovering a lowered glass transition temperature by simply mixing resins has been known.

The present invention relates to a process capable of producing a toner that is excellent in low-temperature fixing ability and has favorable pulverizability and storage property, and a toner produced by the process.

According to the present invention, a toner that is excellent in low-temperature fixing ability and has favorable pulverizability and storage property, can be produced.

These and other advantages of the present invention will be apparent from the following description.

Usually, a resin basically has a crystalline part and an amorphous part, and a resin having high crystallinity is referred to as a crystalline resin. On the other hand, a glass transition temperature of a resin is a physical property attributable to an amorphous part. Therefore, while a crystalline resin having a 100% degree of crystallization does not have a glass transition temperature attributable to an amorphous part, a glass transition temperature appears when a degree of crystallization is lowered.

On the other hand, regarding a glass transition temperature, it has been known that the higher the crystallinity of an overall resin, the higher the glass transition temperature, and that the lower the crystallinity of the overall resin, the lower the glass transition temperature. When a crystalline resin and an amorphous resin are mixed, compatibility of the resins greatly affects a glass transition temperature, so that the higher the compatibility, the lower the glass transition temperature of an overall resin due to a plasticization effect. In some cases, the glass transition temperature of the overall resin is likely to be lower than glass transition temperatures of individual resins. In particular, when the resins to be combined are of the same kinds of resins, as in a case of a crystalline polyester and an amorphous polyester, the tendency is remarkable, thereby undesirably dramatically lowering pulverizability and storage property.

On the other hand, it has been known that the a degree of crystallization of a crystalline resin is improved by adding a heat-treating step at a specific temperature to the process for producing a toner. However, it has not been known that a glass transition temperature of an amorphous resin (or that attributable to an amorphous part) is elevated by a heat-treating step.

Therefore, the present inventors have studied on a process capable of recovering a glass transition temperature that is lowered due to mixing of resins, upon the production of a toner in which a polyester that is effective in low-temperature fixing ability is used as a resin binder. As a result, it has been found that individual resins are stabilized, a plasticization effect is reduced, and the properties of the individual resins can be fully exhibited by adding a step of carrying out a heat treatment at a specific temperature and time as mentioned later. Further, according to the present invention, a surprising finding that even when a crystalline polyester which is effective in the improvement of low-temperature fixing ability but difficult to satisfy both pulverizability and storage property is combined with an amorphous resin, a remarkable effect beyond that of a combination of amorphous polyesters is exhibited, has been obtained.

Each of the steps of the process for producing a toner of the present invention will be sequentially explained hereinbelow.

In the present invention, as the raw materials to be melt-kneaded, two or more kinds of polyesters are at least used as resin binders, wherein the polyester contains at least one kind of an amorphous polyester.

Incidentally, in the present invention, the term "amorphous polyester" refers to a polyester having a ratio of a softening point to a temperature of maximum endothermic peak (softening point/temperature of maximum endothermic peak) being more than 1.3 and 4 or less, and preferably from 1.5 to 3, and the term "crystalline polyester" refers to a polyester having a ratio of a softening point to a temperature of maximum endothermic peak (softening point/temperature of maximum endothermic peak) being from 0.6 to 1.3, preferably from 0.9 to 1.2, more preferably from 0.9 to 1.1, and even more preferably from 0.98 to 1.05. The ratio of the softening point to the temperature of maximum endothermic peak is adjusted by the kinds of the raw material monomers, a ratio and a molecular weight thereof, production conditions (for example, cooling rate), and the like.

An amorphous polyester is obtained by polycondensing an alcohol component and a carboxylic acid component as the raw material monomers.

The alcohol component includes an aromatic diol, such as an alkylene oxide adduct of bisphenol A represented by the formula (I):

[Ka 1]

(I)

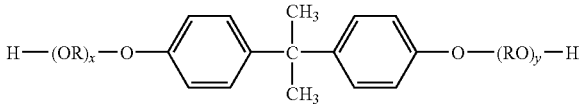

wherein R is an alkylene group having 2 or 3 carbon atoms; x and y are positive numbers, wherein a sum of x and y is from 1 to 16, and preferably from 1.5 to 5.0, such as polyoxypropylene(2.2)-2,2-bis(4-hydroxyphenyl)propane and polyoxyethylene(2.2)-2,2-bis(4-hydroxyphenyl)propane; an aliphatic diol such as ethylene glycol and propylene glycol; a trihydric or higher polyhydric alcohol such as glycerol and pentaerythritol; and the like.

Among the above-mentioned alcohol component, a monomer which enhances the amorphousness of a resin, such as an aromatic diol, such as an alkylene oxide adduct of bisphenol A is preferable. Further, the alkylene oxide adduct of bisphenol A represented by the formula (I) is contained in an amount of preferably 50% by mole or more, and more preferably 80% by mole or more, of the alcohol component, from the viewpoint of strength and chargeability.

In addition, the carboxylic acid component includes aromatic dicarboxylic acids such as phthalic acid, isophthalic acid, and terephthalic acid; aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acid; a tricarboxylic or higher polycarboxylic acid such as trimellitic acid (1,2,4-benzenetricarboxylic acid) and pyromellitic acid; acid anhydrides thereof and alkyl (1 to 3 carbon atoms) esters thereof, and the like. Incidentally, the carboxylic acid compound in the present invention refers to dicarboxylic acids, anhydrides thereof, and alkyl (1 to 3 carbon atoms) ester thereof.

Further, the alcohol component and the carboxylic acid component may properly contain a monohydric alcohol and a monocarboxylic acid compound from the viewpoint of adjusting molecular weight or the like, The polycondensation of the alcohol component and the carboxylic acid component can be carried out, for example, at a temperature of from 180° to 250° C. in an inert gas atmosphere, using an esterification catalyst as desired.

The amorphous polyester has a glass transition temperature of preferably from 40° to 80° C., and more preferably from 50° to 70° C., from the viewpoint of pulverizability and storage property.

The amorphous polyester has a softening point of preferably from 70° to 170° C., more preferably from 80° to 160° C., and even more preferably from 100° to 150° C., and an acid value of preferably from 1 to 50 mgKOH/g, and more preferably from 10 to 30 mgKOH/g.

It is preferable that the amorphous polyester contains two kinds of amorphous polyesters of which softening points are different preferably by 10° C. or more, and more preferably different by from 20° to 60° C., from the viewpoint of satisfying both low-temperature fixing ability and offset resistance. A low-softening point polyester has a softening point of preferably from 80° to 120° C., and more preferably from 85° to 110° C., from the viewpoint of low-temperature fixing ability, and a high-softening point polyester has a softening point of preferably from 120° to 160° C., and more preferably from 130° to 155° C., from the viewpoint of offset resistance. The weight ratio of the high-softening point polyester to the low-softening point polyester (high-softening point polyester/low-softening point polyester) is preferably from 20/80 to 80/20.

Further, it is preferable that the polyester usable in the present invention contains at least one kind of a crystalline polyester in addition to the above-mentioned amorphous polyester. In the present invention, a glass transition temperature of the amorphous polyester can be recovered, even when the amorphous polyester is combined with a crystalline polyester which is difficult to have both pulverizability and storage property at the same time while being very effective in the improvement of low-temperature fixing ability.

The crystalline polyester is also obtained by the polycondensation of an alcohol component and a carboxylic acid component in the same manner as in the amorphous polyester. It is preferable that the alcohol component contains a monomer which promotes crystallinity of a resin, such as an aliphatic diol having 2 to 8 carbon atoms.

The aliphatic diol having 2 to 8 carbon atoms includes ethylene glycol, 1,2-propylene glycol, 1,3-propylene glycol, 1,4-butanediol, 1,5-pentanediol, 1,6-hexanediol, 1,7-heptanediol, 1,8-octanediol, neopentyl glycol, 1,4-butanediol, and the like, and an α,ω-linear alkanediol is more preferable.

The aliphatic diol having 2 to 8 carbon atoms is contained in the alcohol component in an amount of preferably 70% by mole or more, more preferably from 80 to 100% by mole, and even more preferably from 90 to 100% by mole. It is desired that one kind of the aliphatic diol constitutes 70% by mole or more, and preferably from 80 to 95% by mole, of the alcohol component. Among them, it is desired that 1,4-butanediol is contained in the alcohol component in an amount of preferably 60% by mole or more, more preferably from 70 to 100% by mole, and even more preferably from 80 to 100% by mole.

In addition, it is preferable that the carboxylic acid component of the crystalline polyester contains an aliphatic dicarboxylic acid compound from the viewpoint of a degree of crystallization. The aliphatic dicarboxylic acid compound is contained in the carboxylic acid component in an amount of preferably 70% by mole or more, more preferably from 80 to 100% by mole, and even more preferably from 90 to 100% by mole.

Here, the molar ratio of the carboxylic acid component to the alcohol component (carboxylic acid component/alcohol component) in the crystalline polyester is preferably such that the proportion of the alcohol component is larger than the carboxylic acid component, to form a high-molecular crystalline polyester. Further, the molar ratio is preferably 0.9 or more and less than 1, and more preferably 0.95 or more and less than 1, from the viewpoint of easily adjusting the molecular weight of the polyester by distilling off the alcohol component during the reaction under a reduced pressure.

Upon production of the crystalline polyester, the temperature at which the alcohol component and the carboxylic acid component are polycondensed is preferably from 120° to 230° C. The polycondensation of the alcohol component and the carboxylic acid component can be carried out in the same manner as in the amorphous polyester, and an entire monomer may be charged at once in order to enhance the strength of the resin, or divalent monomers may be firstly reacted, and thereafter trivalent or higher polyvalent monomers are added and reacted in order to reduce the low-molecular weight components. In addition, the reaction may be accelerated by subjecting the reaction system to polymerization under a reduced pressure in a second half of the polymerization.

In order to obtain an even high-molecular crystalline polyester, reaction conditions such as adjustment of the molar ratio of the carboxylic acid component to the alcohol component as mentioned above, elevation of the reaction temperature, increase in the amount of the catalyst, and performance of a dehydration reaction for a long period of time under reduced pressure may be selected. Incidentally, a high-molecular, high-viscosity crystalline polyester can be also produced under high-agitation required power. However, when the crystalline polyester is produced without particularly selecting production equipment, a process including the steps of reacting raw material monomers together with a non-reactive low-viscosity resin and a solvent is also an effective means.

The crystalline polyester has a softening point of preferably from 70° to 140° C., more preferably from 105° to 130° C., from the viewpoint of low-temperature fixing ability.

The weight ratio of the amorphous polyester to the crystalline polyester (amorphous polyester/crystalline polyester) is preferably from 95/5 to 50/50, and more preferably from 80/20 to 60/40, from the viewpoint of low-temperature fixing ability, pulverizability, and storage property.

In the present invention, a resin binder other than the polyester, such as a vinyl resin, an epoxy resin, a polycarbonate, or a polyurethane, may be used as a resin binder. However, the polyester is contained in total in an amount of preferably 80% by weight or more, and more preferably 90% by weight or more, of a total amount of a resin binder.

Further, the raw materials of the toner of the present invention may appropriately contain an additive such as a colorant, a releasing agent, a charge control agent, a magnetic powder, an electric conductivity modifier, an extender, a reinforcing filler such as a fibrous substance, an antioxidant, an anti-aging agent, a fluidity improver, or a cleanability improver.

As the colorant, all of the dyes, pigments, and the like, which are used as colorants for a toner can be used, and the colorant includes carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, Carmine 6B, disazoyellow, and the like. These colorants can be used alone or in admixture of two or more kinds. The toner of the present invention can be used as any of black toners, color toners, and full color toners. The colorant is contained in an amount of preferably from 1 to 40 parts by weight, and more preferably from 3 to 10 parts by weight, based on 100 parts by weight of the resin binder.

The releasing agent includes an aliphatic hydrocarbon wax such as a low-molecular weight polypropylene, a low-molecular weight polyethylene, a low-molecular weight polypropylene-polyethylene copolymer, microcrystalline wax, paraffin wax, Fischer-Tropsch wax, and the like, and oxides thereof; an ester wax such as carnauba wax, montan wax, Sazole wax, deoxidized waxes thereof, and the like; fatty acid amides; fatty acids; higher alcohols; metal salts of fatty acids; and the like. Among them, the aliphatic hydrocarbon wax is preferable, from the viewpoint of releasing property and stability.

The releasing agent has a melting point of preferably from 60° to 150° C., and more preferably from 100° to 120° C., from the viewpoint of offset resistance and durability.

The releasing agent is contained in an amount of preferably from 0.5 to 10 parts by weight, and more preferably from 1 to 5 parts by weight, based on 100 parts by weight of the resin binder.

The charge control agent includes a positively chargeable charge control agent such as a Nigrosine dye, a triphenylmethane-based dye containing a tertiary amine as a side chain, a quaternary ammonium salt compound, a polyamine resin and an imidazole derivative; and a negatively chargeable charge control agent such as a metal-containing azo dye, a copper phthalocyanine dye, a metal complex of an alkyl derivative of salicylic acid, and boron complex of benzilic acid.

The charge control agent is contained in an amount of preferably from 0.1 to 5 parts by weight, and more preferably from 0.5 to 2 parts by weight, based on 100 parts by weight of the resin binder.

It is preferable that the raw materials containing the polyester and the like are mixed with a Henschel mixer or the like, and the mixture is then subjected to a melt-kneading step.

The melt-kneading of the raw materials can be carried out by using a known kneader, for example, a closed type kneader, a single-screw or twin-screw extruder, an open-roller type kneader, or the like. The temperature of the melt-kneading is not particularly limited as long as it is a temperature at which each raw material is sufficiently miscible with each other, and is preferably a temperature of (Ta−30) ° C. or more and (Ta+40) ° C. or less, and more preferably a temperature of (Ta−10) ° C. or more and (Ta+30) ° C. or less, wherein Ta refers to a weight-average softening point (° C.) which is a weighed average of softening points of each of the two or more kinds of resin binders.

Next, in an ordinary process, the resulting melt-kneaded product is cooled to a pulverizable hardness, and subjected to a pulverization step. In the present invention, after the melt-kneading step, a heat-treating step is carried out before the pulverization step.

In the present invention, from the viewpoint of maintaining dispersion of a toner additive and rearrangement property of a resin molecule, the heat-treating step is carried out at a temperature t (° C.) and time h (hour) satisfying the following formulas (a) and (b), $$Tg_1 \leqq t \leqq Tm-10 \quad \text{(a)}$$

$$h \geqq 100/(t-30), \text{ with proviso that } t>30 \quad \text{(b)}$$

wherein $Tg_1$ is a glass transition temperature (° C.) of a melt-kneaded product before the heat-treating step; and Tm is the lowest softening point (° C.) of softening points of the two or more kinds of polyesters.

The formula (a) is preferably $Tg_1+10 \leqq t \leqq Tm-20$, and more preferably $Tg_1+15 \leqq t \leqq Tm-30$.

In addition, the formula (b) is preferably $h \geqq 150/(t-30)$, with proviso that $t>30$, and more preferably $h \geqq 200/(t-30)$, with proviso that $t>30$.

Here, h (hour) is preferably 1,000 or less, more preferably 700 or less, and even more preferably 300 or less, from the viewpoint of maintaining dispersion of a toner additive.

In the present invention, by carrying out the heat-treating step at the above-mentioned temperature and for the above-mentioned time, it is presumed that rearrangement of a resin in the melt-kneaded product is accelerated, and that storage property is improved by the recovery of a glass transition temperature which is once lowered. Further, a plastic part, in other words, a low-glass transition temperature part is likely to absorb impact during the pulverization, thereby being causative of lowering a pulverization efficiency. In the present invention, since plasticization is suppressed in the heat-treating step before the pulverization step, the pulverizability can also be improved.

In the heat-treating step, an oven or the like can be used. For example, if an oven is used, the heat-treating step can be carried out by keeping a melt-kneaded product in the oven at a fixed temperature.

Embodiments for carrying out the heat-treating step are not particularly limited. Embodiments include, for example, Embodiment 1: An embodiment including the steps of cooling a melt-kneaded product obtained after the melt-kneading step, including keeping a melt-kneaded product under the above-mentioned heat-treating conditions and cooling the melt-kneaded product to a pulverizable hardness; and subjecting the cooled product to a pulverization step; and Embodiment 2: An embodiment including the steps of once cooling a melt-kneaded product obtained after the melt-kneading step to a pulverizable hardness, subjecting the cooled melt-kneaded product to the above-mentioned heat-treating step, cooling the melt-kneaded product again, and subjecting the cooled product to the pulverization step.

In the present invention, the heat-treating step may be carried out by either embodiment, and the embodiment 2 is preferable, from the viewpoint of dispersibility of an additive in the toner.

In the present invention, the heat-treated product after the heat-treating step has a glass transition temperature of preferably from 50° to 75° C., and more preferably from 55° to 70° C., from the viewpoint of storage property, pulverizability, and low-temperature fixing ability. Further, the heat-treated product after the heat-treating step has a glass transition temperature that is higher than a glass transition temperature of a melt-kneaded product before the heat-treating step by preferably 5° C. or more, more preferably 10° C. or more, and even more preferably 20° C. or more, from the viewpoint of storage stability of the toner.

The heat-treated product after the heat-treating step is cooled to a pulverizable hardness, and thereafter the resulting cooled product is subjected to a pulverization step and a classifying step.

The pulverization step may be carried out in divided multi-stages. For example, the heat-treated product after the heat-treating step may be roughly pulverized to a size of from 1 to 5 mm or so, and thereafter the resulting roughly pulverized product is further finely pulverized to a desired particle size.

The pulverizer used in the pulverization step is not particularly limited. For example, the pulverizer used preferably in the rough pulverization includes an atomizer, Rotoplex, and the like, and the pulverizer used preferably in the fine pulverization includes a jet mill, an impact type mill, a rotary mechanical mill, and the like.

The classifier used in the classifying step includes an air classifier, a rotor type classifier, a sieve classifier, and the like. During the classifying step, the pulverized product which is insufficiently pulverized and removed may be subjected to the pulverization step again.

The toner is obtained through the above steps. Further, fine inorganic particles such as hydrophobic silica, or fine resin particles may be externally added to the surface of the resulting toner. The weight-average particle size ($D_4$) of the toner is preferably from 3 to 15 μm, and more preferably from 4 to 8 μm.

The toner obtainable by the process of the present invention can be used as any of a toner for monocomponent development and a toner for two component development in which the toner mixed with a carrier is used, and the toner is more preferably used as a toner for monocomponent development of which heat resistance is more required.

EXAMPLES

The following examples further describe the present invention in more detail, however, the examples are not to be construed as limitations of the present invention.

[Softening Point]

Softening point refers to a temperature corresponding to h/2 (a temperature at which half of the resin flows out), wherein the height of the S-shaped curve is h, showing the relationship between the downward movement of a plunger (flow length) and temperature, when measured by using a flow tester of the "koka" type ("CFT-500D," manufactured by Shimadzu Corporation) in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

[Temperature of the Maximum Endothermic Peak, Glass Transition Temperature, and Melting Point]

By using a differential scanning calorimeter ("DSC 210," manufactured by Seiko Instruments, Inc.), the temperature is raised to 200° C., the hot sample is cooled to 0° C. at a cooling rate of 10° C./min, and thereafter the cooled sample is measured while the temperature is raised again at a rate of 10° C./min. The temperature of the maximum endothermic peak and the temperature of an intersection of the extension of the baseline of equal to or lower than the temperature of the maximum endothermic peak and the tangential line showing the maximum inclination between the kickoff of the peak and the top of the peak are determined. In the present invention, when a sample containing an amorphous resin as a main component is used, the latter temperature is referred to as a glass transition temperature. When the releasing agent is used as sample, the former temperature is referred to as a melting point.

[Acid Value]

The acid value is determined according to the method of JIS K0070.

Production Example 1 for Amorphous Polyester

A 5-liter four-neck flask equipped with a nitrogen inlet tube, a dehydration tube, a stirrer, and a thermocouple was charged with the raw material monomers shown in Table 1 other than trimellitic anhydride, and 6 g of tin octylate. The ingredients in the flask were reacted at 220° C. over a period of 8 hours, and further reacted at 8.3 kPa at 220° C. for 1 hour. Further, trimellitic anhydride was added thereto at a temperature of 210° C., and the mixture was reacted until a desired softening point was reached, to give resin A.

Production Example 2 for Amorphous Polyester

A 5-liter four-neck flask equipped with a nitrogen inlet tube, a dehydration tube, a stirrer, and a thermocouple was charged with the raw material monomers shown in Table 1 and 6 g of tin octylate. The ingredients in the flask were reacted at 220° C. over a period of 8 hours, and further reacted at 8.3 kPa at 220° C. for 1 hour. Further, the mixture was reacted at a temperature of 210° C. until a desired softening point was reached, to give resins B and C.

TABLE 1

| | Amorphous Polyester | | |
|---|---|---|---|
| | Resin A | Resin B | Resin C |
| Alcohol Component | | | |
| BPA-PO [1)] | 1225 g (50) | 2205 g (90) | 245 g (100) |
| BPA-EO [2)] | 1138 g (50) | 228 g (10) | — |
| Carboxylic Acid Component | | | |
| Fumaric acid | 609 g (75) | — | — |
| Terephthalic acid | — | 988 g (85) | 837 g (72) |
| Trimellitic Anhydride | 336 g (25) | — | — |
| Physical Properties of Resin | | | |
| Acid Value (mgKOH/g) | 22.5 | 15.4 | 10.8 |
| Softening Point (° C.) | 147.3 | 103.4 | 83.2 |
| Glass Transition Temp. (° C.) | 62.4 | 61.2 | 47.6 |
| Temperature of Maximum Endothermic Peak (° C.) | 64.6 | 63.7 | 50.0 |

Note)
The amount in parenthesis is expressed as molar ratio.
[1)] Polyoxypropylene(2.2)-2,2-bis(4-hydroxyphenyl)propane
[2)] Polyoxyethylene(2.2)-2,2-bis(4-hydroxyphenyl)propane Production Example 1 for Crystalline Polyester A 5-liter four-neck flask equipped with a nitrogen inlet tube, a dehydration tube, a stirrer, and a thermocouple was charged with the raw material monomers shown in Table 2 and 2 g of hydroquinone. The ingredients in the flask were reacted at 160° C. over a period of 5 hours, and heated to 200° C. to react for one hour. Thereafter, the ingredients were further reacted at 8.3 kPa for 1 hour, to give resin a.

Production Example 2 for Crystalline Polyester

A 5-liter four-neck flask equipped with a nitrogen inlet tube, a dehydration tube, a stirrer, and a thermocouple was charged with the raw material monomers shown in Table 2. The ingredients in the flask were reacted at 200° C. until granules of terephthalic acid were not observed. Thereafter, the ingredients were further reacted at 8.3 kPa for 3 hours, to give resin b.

TABLE 2

| | Crystalline Polyester | |
|---|---|---|
| | Resin a | Resin b |
| Alcohol Component | | |
| 1,4-Butanediol | 1215 g (90) | — |
| 1,6-Hexanediol | 177 g (10) | 1416 g (100) |

TABLE 2-continued

| | Crystalline Polyester | |
|---|---|---|
| | Resin a | Resin b |
| Carboxylic Acid Component | | |
| Fumaric acid | 1740 g (100) | — |
| Terephthalic acid | — | 1693 g (85) |
| Adipic acid | — | 259 g (15) |
| Physical Properties of Resin | | |
| Softening Point (° C.) | 122.0 | 116.6 |
| Temperature of Maximum Endothermic Peak (° C.) | 124.6 | 119.5 |

Note)
The amount in parenthesis is expressed as molar ratio.

Examples 1, 3 to 9 and Comparative Examples 1 to 4

The resin binders and the releasing agent shown in Table 3, 4 parts by weight of a carbon black "Regal 330" (manufactured by Cabot Corporation), and 0.5 parts by weight of a charge control agent "T-77" (manufactured by Hodogaya Chemical Co., Ltd.) were sufficiently mixed with a Henschel mixer. Thereafter, the mixture was melt-kneaded using a co-rotating twin-screw extruder (PCM-30-30, manufactured by IKEGAI Corporation) having an entire length of the kneading portion of 1560 mm, a screw diameter of 42 mm, and a barrel inner diameter of 43 mm. The heating temperature within the barrel was 100° C., the rotational speed of the screw was 150 r/min., the feeding rate of the mixture was 10 kg/h, and the average residence time was about 18 seconds.

The resulting melt-kneaded product was rolled with a cooling roller, and cooled to a temperature of 20° C. or lower. Thereafter, the cooled product was heat-treated in an oven at a temperature and time shown in Table 3.

The heat-treated product after the heat treatment was mechanically pulverized, and classified, to give a powder having a weight-average particle size ($D_4$) of 7.5 μm.

One part by weight of a hydrophobic silica "R-972" (manufactured by Nippon Aerosil Co., LTD.) and 1 part by weight of a hydrophobic silica "NAX-50" (manufactured by Nippon Aerosil Co., LTD.) were added as external additives to 100 parts by weight of the resulting powder, and the mixture was mixed with a Henschel mixer, to give a toner.

Example 2

The same procedures as in Example 1 were carried out except that 6 parts by weight of "Super Magenta R" (Pigment Red 122, manufactured by Dainippon Ink and Chemicals Incorporated) is used in place of a carbon black as a colorant, to give a toner.

Test Example 1 [Low-Temperature Fixing Ability]

A toner was loaded in a copy machine "AR-505" (manufactured by Sharp Corporation), and an unfixed image (2 cm×12 cm) having an amount of toner adhesion of 0.5 mg/cm$^2$ was obtained.

The unfixed image obtained was subjected to a fixing test by fixing with a fixing device (fixing speed: 100 mm/sec) in a copy machine "AR-505" (manufactured by Sharp Corporation) which was modified so that the unfixed image could be fixed off-line, while sequentially raising the temperature from 90° to 240° C. in increments of 5° C. As the sheets to be fixed, "CopyBond SF-70NA" (manufactured by Sharp Corporation, 75 g/m$^2$) was used.

A sand-rubber eraser, of which bottom had a size of 15 mm×7.5 mm, to which a load of 500 g was applied was moved backward and forward five times over a fixed image obtained. Thereafter, the optical reflective densities of the fixed images before and after rubbing were measured with a reflective densitometer "RD-915" (manufactured by Macbeth Process Measurements Co.). The temperature of the fixing roller at which the ratio of the both optical reflective densities (after rubbing/before rubbing) initially exceeds 70% was defined as the lowest fixing temperature. The low-temperature fixing ability was evaluated in accordance with the following evaluation criteria. The results are shown in Table 3.

Evaluation Criteria

◎: Lowest fixing temperature being lower than 140° C.;

○: Lowest fixing temperature being 140° C. or higher and lower than 160° C.; and X: Lowest fixing temperature being 160° C. or higher.

Test Example 2 [Pulverizability]

A toner pulverized with Rotoplex attaching a 3 mm mesh was pulverized with I-2-type pulverizer (manufactured by Nippon Pneumatic Mfg. Co., Ltd.) at a pulverization pressure of 0.5 Pa. The pulverizability was evaluated in accordance with the following evaluation criteria. The results are shown in Table 3.

[Evaluation Criteria]

◎: Pulverization efficiency being 3 kg/hr or higher;

○: Pulverization efficiency being 2 kg/hr or higher and lower than 3 kg/hr;

Δ: Pulverization efficiency being 1 kg/hr or higher and lower than 2 kg/hr; and

X: Pulverization efficiency being 1 kg/hr or lower.

Test Example 3 [Storage Property]

Four grams of a toner was allowed to stand under the environment of a temperature of 50° C. and a relative humidity of 60% for 148 hours. Thereafter, the state of the toner was visually observed. The storage property was evaluated in accordance with the following evaluation criteria. The results are shown in Table 3.

[Evaluation Criteria]

◎: No aggregation is found at all;

○: Aggregation is hardly found;

Δ: Aggregation is slightly found; and

X: Particles are formed into a lump.

TABLE 3

| | Resin Binder | | | | Heat-Treating Step | | | Low-Temp. | | | | |
|---|---|---|---|---|---|---|---|---|---|---|---|---|
| | Amorphous Polyester | Crystalline Polyester | Releasing Agent[1)] | $Tg_1$[2)] (° C.) | Temp. t (° C.) | Time t (hour) | 100/ t − 30 | $Tg_2$[3)] (° C.) | $Tg_2 - Tg_1$ | Fixing Ability | Pulveriz-ability | Storage Property |
| Ex. 1 | Resin A (50) Resin B (20) | Resin a (30) | NP-105 (2) | 31.3 | 50 | 12 | 5 | 58.1 | +26.8 | ◎ | ◎ | ◎ |
| Ex. 2 | Resin A (50) Resin B (20) | Resin a (30) | NP-105 (2) | 29.0 | 50 | 12 | 5 | 56.6 | +27.6 | ◎ | ◎ | ◎ |
| Ex. 3 | Resin A (50) Resin B (20) | Resin a (30) | NP-105 (2) | 31.3 | 50 | 6 | 5 | 51.3 | +20.0 | ◎ | ○ | ○ |
| Ex. 4 | Resin A (50) Resin B (20) | Resin a (30) | NP-105 (2) | 31.3 | 75 | 5 | 2.2 | 57.2 | +25.9 | ◎ | ◎ | ◎ |
| Ex. 5 | Resin A (50) Resin B (20) | Resin a (30) | NP-105 (2) | 31.3 | 40 | 24 | 10 | 57.7 | +26.4 | ◎ | ◎ | ◎ |
| Ex. 6 | Resin A (50) Resin B (20) | Resin a (30) | NP-105 (2) | 31.3 | 50 | 240 | 5 | 60.1 | +28.8 | ◎ | ◎ | ◎ |
| Ex. 7 | Resin A (50) Resin B (20) | Resin b (30) | NP-105 (2) | 27.5 | 50 | 12 | 5 | 57.5 | +30.0 | ◎ | ○ | ◎ |
| Ex. 8 | Resin A (50) Resin C (50) | — | NP-105 (2) | 55.2 | 60 | 12 | 3.3 | 59.8 | +4.6 | ○ | ◎ | ○ |
| Ex. 9 | Resin A (50) Resin B (50) | — | Carnauba (10) | 57.4 | 60 | 12 | 3.3 | 62.1 | +4.7 | ○ | ○ | ◎ |
| Comp. Ex. 1 | Resin A (50) Resin B (20) | Resin a (30) | NP-105 (2) | 31.3 | 20 | 12 | — | 31.4 | +0.1 | ◎ | X | X |
| Comp. Ex. 2 | Resin A (50) Resin B (20) | Resin a (30) | NP-105 (2) | 31.3 | 50 | 3 | 5 | 43.9 | +12.6 | ◎ | Δ | X |
| Comp. Ex. 3 | Resin A (50) Resin C (50) | — | NP-105 (2) | 55.2 | 20 | 12 | — | 55.1 | −0.1 | ○ | ◎ | X |
| Comp. Ex. 4 | Resin A (50) Resin B (50) | — | Carnauba (10) | 57.4 | 20 | 12 | — | 57.2 | −0.2 | ○ | X | ○ |

Note)

The figure in parenthesis expresses the amount of the resin binder and the releasing agent used (in parts by weight).

[1)]NP-105: manufactured by MITSUI CHEMICALS, INC., Polypropylene wax, Melting point: 140° C. Carnauba (Carnauba Wax C1): manufactured by Kato Yoko, Melting point: 80° C.

[2)]$Tg_1$: Glass Transition Temperature of the melt-kneaded product before heat-treating step

[3)]$Tg_2$: Glass Transition Temperature of the heat-treated product after heat-treating step It can be seen from the above results that the toners of Examples produced through the given heat-treating step are excellent in any of fixing ability, pulverizability, and storage property. Particularly, according to the toners of Examples 1 to 7, when an amorphous polyester and a crystalline polyester are used in combination, it is clear that a difference of glass transition temperatures before and after the heat-treating step is large, so that a remarkable effect is exhibited.

On the other hand, in the toners of Comparative Examples 1 and 2, pulverizability and storage property are insufficient even though fixing ability is favorable by using a crystalline polyester in combination.

In addition, from the comparison of Example 8 and Comparative Example 3, or the comparison of Example 9 and Comparative Example 4, it can be seen that pulverizability and storage property can be improved by carrying out a given heat treatment even though a resin having a very low softening point or a wax having a low melting point is used.

The toner obtainable according to the present invention is used favorably, for example, for developing latent images formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A process for producing a toner comprising:

melt-kneading raw materials comprising two or more kinds of polyesters to form a melt-kneaded product, heat-treating the melt-kneaded product to form a heat-treated product, pulverizing the heat-treated product to form a pulverized product, and classifying the pulverized product, wherein the two or more kinds of polyesters comprise at least one kind of an amorphous polyester;

the heat-treating is carried out at a temperature t (° C.) and time h (hour) satisfying formulas (a) and (b), $$Tg_1 \leqq t \leqq Tm-10 \quad \text{(a)}$$

$$h \geqq 100/(t-30), \text{ with proviso that } t>30 \quad \text{(b)}$$

wherein $Tg_1$ is a glass transition temperature (° C.) of the melt-kneaded product before the heat-treating step; and Tm is the lowest softening point (° C.) of softening points of the two or more kinds of polyesters; and the amorphous polyester comprises two kinds of amorphous polyesters of which softening points are different by 10° C. or more, wherein a softening point of a low-softening point polyester is from 80° to 120° C., and a softening point of a high-softening point polyester is from 120° to 160° C.

2. The process according to claim 1, wherein the two or more kinds of polyesters further comprise at least one kind of a crystalline polyester.

3. The process according to claim 2, wherein an alcohol component of the crystalline polyester comprises an aliphatic diol having 2 to 8 carbon atoms in an amount of 70% by mole or more.

4. The process according to claim 2, wherein a carboxylic acid component of the crystalline polyester comprises an aliphatic dicarboxylic acid compound in an amount of 70% by mole or more.

5. The process according to claim 2, wherein the amorphous polyester has a glass transition temperature of from 40° to 80° C., and the crystalline polyester has a softening point of from 70° to 140° C.

6. The process according to claim 2, wherein a weight ratio expressed by amorphous polyester/crystalline polyester is from 95/5 to 50/50.

7. The process according to claim 1, wherein the heat-treated product after the heat-treating step has a glass transition temperature that is higher than a glass transition temperature of the melt-kneaded product before the heat-treating step by 5° C. or more.

8. The process according to claim 1, comprising, subsequent to the melt-kneaded step, once cooling the resulting melt-kneaded product to a pulverizable hardness, subjecting the cooled melt-kneaded product to the heat-treating step, cooling the resulting melt-kneaded product again, and subjecting the cooled product to the pulverizing step.

9. A process for producing a toner comprising:

melt-kneading raw materials comprising two or more kinds of polyesters to form a melt-kneaded product, heat-treating the melt-kneaded product to form a heat-treated product, pulverizing the heat-treated product to form a pulverized product, and classifying the pulverized product, wherein the two or more kinds of polyesters comprise at least one kind of an amorphous polyester;

the heat-treating is carried out at a temperature t (° C.) and time h (hour) satisfying formulas (a) and (b), $$Tg_1 \leqq t \leqq Tm-10 \quad \text{(a)}$$

$$h \geqq 100/(t-30), \text{ with proviso that } t>30 \quad \text{(b)}$$

wherein $Tg_1$ is a glass transition temperature (° C.) of the melt-kneaded product before the heat-treating step; and Tm is the lowest softening point (° C.) of softening points of the two or more kinds of polyesters; and the heat-treated product after the heat-treating step has a glass transition temperature that is higher than a glass transition temperature of the melt-kneaded product before the heat-treating step by 5° C. or more.

10. The process according to claim 9, wherein the two or more kinds of polyesters further comprise at least one kind of a crystalline polyester.

11. The process according to claim 10, wherein an alcohol component of the crystalline polyester comprises an aliphatic diol having 2 to 8 carbon atoms in an amount of 70% by mole or more.

12. The process according to claim 10, wherein a carboxylic acid component of the crystalline polyester comprises an aliphatic dicarboxylic acid compound in an amount of 70% by mole or more.

13. The process according to claim 10, wherein the amorphous polyester has a glass transition temperature of from 40° to 80° C., and the crystalline polyester has a softening point of from 70° to 140° C.

14. The process according to claim 10, wherein a weight ratio expressed by amorphous polyester/crystalline polyester is from 95/5 to 50/50.

15. The process according to claim 9, comprising, subsequent to the melt-kneaded step, once cooling the resulting melt-kneaded product to a pulverizable hardness, subjecting the cooled melt-kneaded product to the heat-treating step, cooling the resulting melt-kneaded product again, and subjecting the cooled product to the pulverizing step.

* * * * *